US008857623B2

(12) United States Patent
Wiseman

(10) Patent No.: US 8,857,623 B2
(45) Date of Patent: Oct. 14, 2014

(54) SCREEN RETAINER HAVING ADJUSTABLE TENSIONING

(76) Inventor: Michael D. Wiseman, Tomball, TX (US)

( * ) Notice: Subject to any disclaimer, the term of this patent is extended or adjusted under 35 U.S.C. 154(b) by 473 days.

(21) Appl. No.: 13/098,179

(22) Filed: Apr. 29, 2011

(65) Prior Publication Data

US 2012/0273398 A1 Nov. 1, 2012

(51) Int. Cl.
*B07B 1/49* (2006.01)
*B07B 1/48* (2006.01)

(52) U.S. Cl.
CPC ..... *B07B 1/48* (2013.01); *B07B 2201/02* (2013.01)
USPC ..... 209/403; 209/405; 403/374.1

(58) Field of Classification Search
USPC ..... 209/363, 395, 399, 403, 405, 409, 412, 209/413; 403/374.1, 409.1
See application file for complete search history.

(56) References Cited

U.S. PATENT DOCUMENTS

| | | | | |
|---|---|---|---|---|
| 3,203,548 | A * | 8/1965 | Roubal | 209/399 |
| 3,517,638 | A * | 6/1970 | Kern | 116/298 |
| 4,592,425 | A | 6/1986 | Oliver, Jr. et al. | |
| 4,634,535 | A | 1/1987 | Lott | |
| 5,190,645 | A | 3/1993 | Burgess | |
| 5,641,070 | A | 6/1997 | Seyffert | |
| 6,220,445 | B1 | 4/2001 | Williams | |
| 6,401,935 | B1 | 6/2002 | Wiseman | |
| 6,715,611 | B2 | 4/2004 | Crabbe et al. | |
| 6,736,270 | B2 | 5/2004 | Adams et al. | |
| 6,848,583 | B2 | 2/2005 | Largent et al. | |
| 7,093,678 | B2 | 8/2006 | Risher et al. | |
| 7,410,013 | B2 | 8/2008 | Fisher | |
| 7,537,376 | B2 | 5/2009 | Von Alfthan | |
| 7,753,213 | B2 | 7/2010 | Nogalski | |
| 7,857,077 | B2 | 12/2010 | Reddoch, Sr. | |

(Continued)

FOREIGN PATENT DOCUMENTS

| | | | |
|---|---|---|---|
| EP | 932438 | A1 | 8/1999 |
| WO | 9219354 | A1 | 11/1992 |

(Continued)

OTHER PUBLICATIONS

International Search Report for International Application No. PCT/US2012/035611 dated Jul. 10, 2012.

(Continued)

*Primary Examiner* — Joseph C Rodriguez
*Assistant Examiner* — Kalyanavenkateshware Kumar
(74) *Attorney, Agent, or Firm* — Novak Druce Connolly Bove + Quigg LLP

(57) ABSTRACT

A screen retainer having adjustable tensioning includes a bushing and a tensioning device. The bushing has a center and a thickness that varies radially about the center. The tensioning device includes a surface adapted to receive the bushing, a spring, an engagement member, and at least one screen contact surface. The engagement member is coupled to the tensioning device and is adapted to engage the bushing. The engagement member can be eccentric with respect to the center of the bushing in an installed configuration. The at least one screen contact surface is adapted to engage and place a compressive force on the screen when the spring is placed in compression by an exertion of force by the engagement member on the bushing. The compressive force placed on the screen can be varied based at least in part on a rotation of the bushing on the surface.

20 Claims, 5 Drawing Sheets

(56) References Cited

U.S. PATENT DOCUMENTS

| | | | |
|---|---|---|---|
| 7,866,482 | B2 | 1/2011 | Barrett |
| 7,909,172 | B2 | 3/2011 | Carr |
| 7,922,003 | B2 | 4/2011 | Timmerman et al. |
| 2002/0162807 | A1 | 11/2002 | Kulbeth |
| 2005/0183994 | A1 | 8/2005 | Hensley et al. |
| 2006/0219608 | A1 | 10/2006 | Scott et al. |
| 2007/0095365 | A1 | 5/2007 | Desormeaux |
| 2008/0093269 | A1 | 4/2008 | Timmerman et al. |
| 2009/0057206 | A1 | 3/2009 | Larson et al. |
| 2009/0120846 | A1 | 5/2009 | Burnett |
| 2009/0145816 | A1 | 6/2009 | Dufilho et al. |
| 2009/0242466 | A1 | 10/2009 | Burnett et al. |
| 2010/0181265 | A1 | 7/2010 | Schulte, Jr. et al. |
| 2010/0270216 | A1 | 10/2010 | Burnett et al. |

FOREIGN PATENT DOCUMENTS

| | | | |
|---|---|---|---|
| WO | 9816295 | A1 | 4/1998 |
| WO | 2009027750 | A2 | 3/2009 |
| WO | 2012149437 | A1 | 11/2012 |

OTHER PUBLICATIONS

International Preliminary Report on Patentability for International Application No. PCT/US2012/035611 dated Nov. 7, 2013.

Written Opinion for International Application No. PCT/US2012/035611 dated Jul. 10, 2012.

* cited by examiner

SCREEN RETAINER HAVING ADJUSTABLE TENSIONING

FIELD

This disclosure relates to shale shakers, and more particularly, to a shale shaker screen retainer having adjustable tensioning.

BACKGROUND

The need for solids control in drilling mud in hydrocarbon well drilling is well known in the prior art. Drilling mud, typically a mixture of clay, water and various additives, is pumped through a hollow drill string (pipe, drill collar, bit, etc.) down into a well and exits through holes in a drill bit. The mud picks up cuttings (rock bits) and other solids from the well and carries them upwardly away from the bit and out of the well in a space between the well walls and the drill string. At the top of the well, the solids-laden mud is introduced to a shale shaker, a device which typically has a series of screens arranged in tiered or flat disposition with respect to each other. The screens catch and remove solids from the mud as the mud passes through them. If drilled solids are not removed from the mud used during the drilling operation, recirculation of the drilled solids can create viscosity and gel problems in the mud, as well as increasing wear in mud pumps and other mechanical equipment used for drilling. In some shale shakers, a fine screen cloth is used with the vibrating screen. The screen may have two or more overlying layers of screen cloth. The frame of the vibrating screen is suspended or mounted upon a support and is caused to vibrate by a vibrating mechanism, e.g. an unbalanced weight on a rotating shaft connected to the frame. Each screen may be vibrated by vibratory equipment to create a flow of trapped solids toward an end of the screen on a top surface of the screen for removal and disposal of solids. The fineness or coarseness of the mesh of a screen may vary depending upon mud flow rate and the size of the solids to be removed.

BRIEF DESCRIPTION OF THE DRAWINGS

The foregoing features of the disclosure will be more readily understood by reference to the following detailed description, taken with reference to the accompanying drawings, in which.

DETAILED DESCRIPTION

Figure 1:
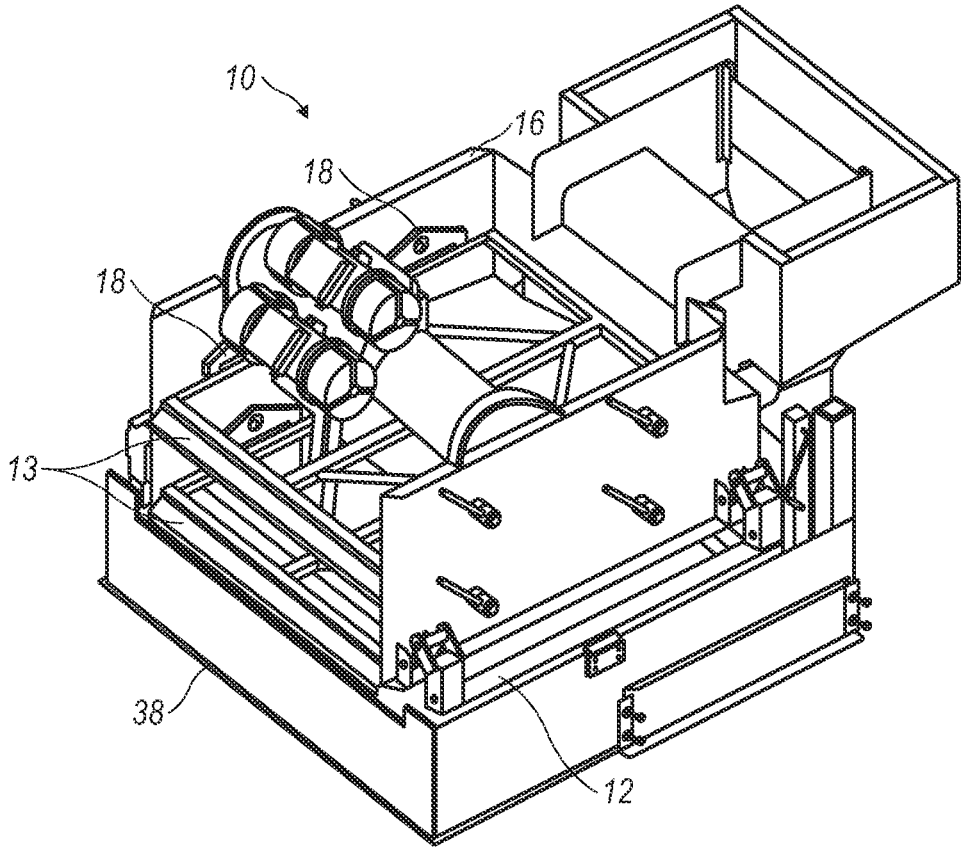
FIG. 1 is a perspective view of a shale shaker installed with a screen retainer having adjustable tensioning in accordance with an exemplary embodiment of the present disclosure.

A screen retainer having adjustable tensioning configured according to the present teachings will hereinafter be described more fully with reference to the accompanying drawings in which embodiments of the crankcase cover are illustrated. The screen retainer having adjustable tensioning, however, be embodied in many different forms and should not be construed as limited to the embodiments set forth herein. For example, the screen retainer having adjustable tensioning can be implemented in devices other than a shale shaker and can retain other components than a screen. The screen retainer having adjustable tensioning can be implemented in other devices where one component needs to be retained at varying tensions. Rather, these embodiments are provided so that this disclosure will be thorough and complete, and will fully convey the scope of the disclosure to those persons skilled in the art. In the figures and description, like reference numbers refer to like elements throughout. Additionally, it will be appreciated that the term "coupled," as used herein, is defined as connected, whether directly or indirectly through intervening components and is not necessarily limited to physical connections.

A screen retainer having adjustable tensioning can include a bushing and a tensioning device adapted to receive the bushing. The bushing can have a center and a thickness. The thickness of the bushing can vary radially about the center of the bushing. The tensioning device can include a surface, a spring, an engagement member, and at least one screen contact surface. The surface can be adapted to receive the bushing. For example, the tensioning device can include a housing that defines the surface. The surface can be shaped to correspond to the shape of the bushing. The engagement member can be adapted to engage the bushing. The engagement member can also be couplable to the surface. The engagement member can also be configured to be eccentric with respect to the center of the bushing, in the event the engagement member and the bushing are engaged. The at least one screen contact surface can be adapted to engage and place a compressive force placed on the screen when the screen is supported by the screen support and when the spring is placed in compression by an exertion of force by the engagement member on the bushing, in the event the engagement member and the bushing are engaged. When the engagement member and the bushing are engaged, the compressive force placed on the screen can be varied based at least in part on a rotation of the bushing on the surface. For example, as the bushing has a varying thickness, the magnitude of the force exerted by the engagement member on the surface will be dependent on the thickness of the portion of the bushing engaging the engagement member. In one example, if the engagement member engages the bushing at the portion having the thickest thickness, the engagement member can exert a larger force on the bushing (and as a result, the screen contact surface will place a larger compressive force placed on the screen) than at the portion having the thinnest thickness.

Figure 2:
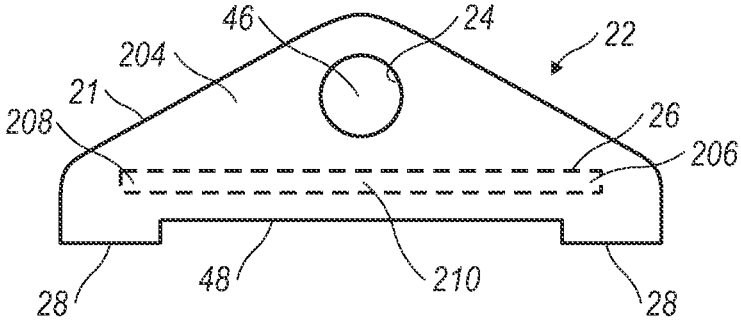
FIG. 2 is a side view of an exemplary embodiment of a tensioning device for a screen retainer having adjustable tensioning in accordance with an exemplary embodiment of the present disclosure.
Figure 3:
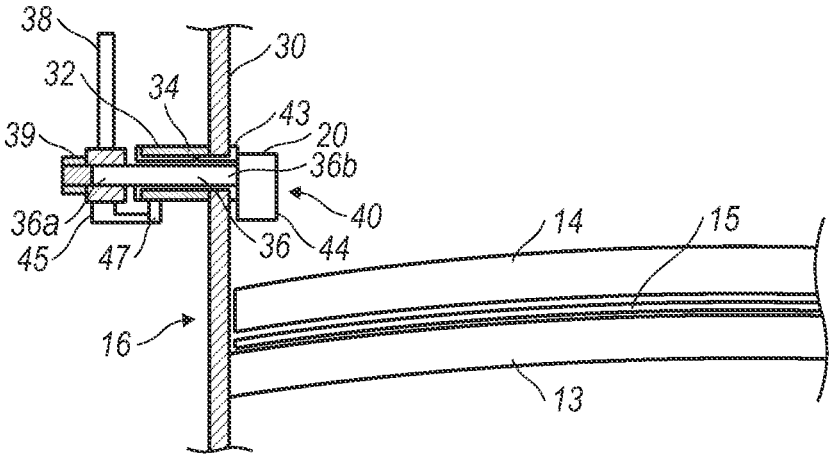
FIG. 3 is a partial cross-sectional view of a basket in which a screen retainer having adjustable tensioning is housed in accordance with an exemplary embodiment of the present disclosure.
Figure 4:
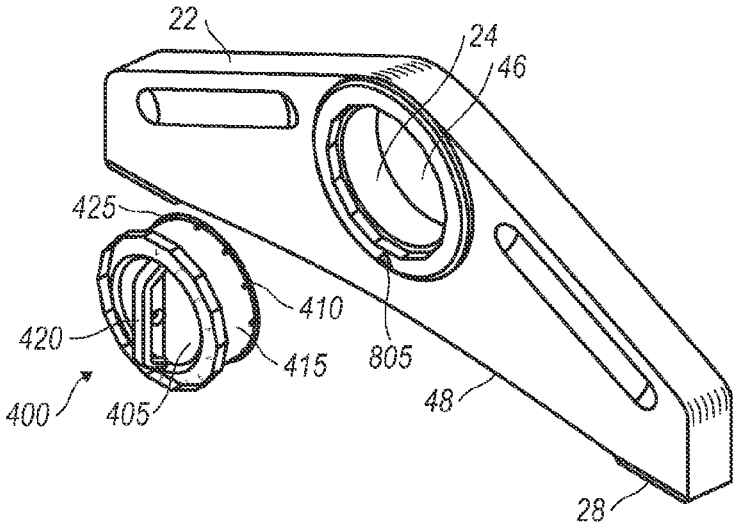
FIG. 4 is a perspective view of a screen retainer having adjustable tensioning in accordance with an exemplary embodiment of the present disclosure.

Referring to FIG. 1, there is shown a shale shaker 10 having a base 12, shaker screen supports 13, a basket 16, and screen retainers 18 for releasably mounting the shaker screen 14 (not shown) to the basket 16. The basket 16 is mounted movably with respect to and on the base 12. Referring to FIGS. 2, 3 and 4, the screen retainer 18 can include an engagement member 40 (shown in FIG. 3), a bushing 400 (shown in FIG. 4), and a tensioning device 22 (shown in FIG. 2). As illustrated in FIG. 1, the tensioning device 22 and the bushing 400 are located within the basket 16 in an installed position. The tensioning device 22 can have a surface 24 adapted to receive the bushing 400 in an installed configuration. The tensioning device 22 can include a spring 26 responsive to the surface 24. For example, in one embodiment, when the screen retainer 18 is assembled, the spring 26 can be placed in compression in response to the engagement member 40 exerting a force on the bushing 400, and thereby exerting a force on the surface 24 to place the spring 26 in compression. The tensioning device 22 can also include a screen contact surface 28 for engaging the shaker screen 14, when the spring 26 is placed in compression by the exertion of force by the bushing 400 on the surface 24 in an assembled configuration. Further details as to the tensioning device 22, the bushing 400, and the engagement member 40 will be described in detail below with respect to FIGS. 3-4.

FIG. 2 is a side view of an exemplary tensioning device 22 of the screen retainer 18 having adjustable tensioning. As illustrated in FIG. 2, the tensioning device 22 includes a housing 21. The housing 21 can be a rigid structure, a semi-rigid structure, or a semi-flexible structure. For example, the housing 21 can be formed of a polymeric material, a plastic material, a rubber material, a composite material, a metal, a plastic, or a combination of materials. In FIG. 2, the housing 21 is a rigid structure. In the exemplary embodiment illustrated in FIG. 2, the housing 21 has a triangular-shape having rounded vertices. However, in other embodiments, the housing 21 can have other shapes. For example, the housing 21 can be a post, an inverted T-shaped housing, or other structure which can be configured to mount a shaker screen 14 to a basket 16 of a shale shaker 10. The housing 21 defines a surface 24 adapted to receive a bushing 400. In FIG. 2, the tensioning device includes an upper portion 204. The surface 24 can be defined by the upper portion 204. For example, in FIG. 2, the surface 24 defines an aperture 46 which is adapted to receive the bushing 400. In FIG. 2, the surface 24 defines a circular aperture 46; however, the surface 24 can define other shapes. For example, the surface 24 can define an aperture corresponding to the shape of the bushing 400. In other embodiments the surface 24 need not define an aperture. Instead, the surface 24 can be a notch at an edge of the housing 21, a semi-circular cutout of the housing 21, or other shaped surface that is adapted to receive the bushing 400.

In FIG. 2, the tensioning device 22 includes at least one screen contact surface 28. Specifically, in the exemplary embodiment of FIG. 2, the tensioning device 22 includes two screen contact surfaces 28; however, those of ordinary skill in the art will appreciate that the tensioning device 22 can include fewer or more screen contact surface 28 than as illustrated. The at least one screen contact surface 28 can be adapted to engage a screen 14 (shown in FIG. 3) mounted in the screen retainer 18. The at least one screen contact surface 28 can also be adapted to place a compressive force on the screen 14 when the screen is supported in the basket 16 and when a spring 26 coupled to the tensioning device 22 is placed in compression by an exertion of force by the engagement member 40 on the bushing 400.

In FIG. 2, the tensioning device 22 can include a spring 26. As illustrated in FIG. 2, the spring 26 can be located between the upper portion 204 and the at least one screen contact surfaces 28. In the exemplary embodiment illustrated in FIG. 2, the spring 26 is an elongated spring. The elongated spring can include a first end portion 206, a second end portion 208, and a mid portion 210. In FIG. 2, one of the at least one contact surfaces 28 is located on the first end portion 206 of the spring 26. Another one of the at least one contact surface 28 can be located at the second end portion 208 of the spring 26. The upper portion 204 of the tensioning device 22 can be coupled to the mid portion. The spring 26 is responsive to the surface 24. For example, forces exerted on the surface 24 are consequently exerted on the spring 26. For example, forces exerted on the surface 24 can exert a force on the spring 26 to compress the spring, deflect the spring 24, or otherwise displace or deform the spring 26. In at least one exemplary embodiment, the engagement member 40 (illustrated in FIG. 3) can exert a force on the bushing 400, which in turn exerts a force on the surface 24, which thereby exerts a force on the spring 26 to deflect the spring 26. The deflection of the spring 26 can place a compressive force on a screen engaged with the at least one contact surface 28, thereby retaining the screen in the screen retainer 18.

FIG. 3 illustrates an exemplary engagement member 40 coupled a basket 16 of a shale shaker. As illustrated in FIG. 3, the engagement member 40 illustrated in FIG. 3 is a shaft 36 having a disc 44 coupled thereto. The disc 44 can be configured to engage the bushing 400. In one embodiment, such as illustrated in FIG. 3, the disc 44 can have a cam surface 40. In other embodiments, the engagement member 400 can be an eccentric cam, a disc eccentrically coupled to a shaft, a shaft having a cam surface at an end of the shaft, or other structure which can engage the bushing 400 and exert a force on the bushing 400 thereby placing a compression force on a screen retained by the screen retainer 10. Also illustrated in FIG. 3, the basket 16 includes a side wall 30. A sleeve 32 is coupled to the side wall 30. The sleeve 32 can define a hole 34 extending therethrough. The hole 34 can be defined by the side wall 30. The hole 34 can extend substantially perpendicular to the side wall 30 through the sleeve 32 and the side wall 30. As recited above, the exemplary engagement member 40 is a shaft 36 having a disc 44 coupled thereto, the disc 44 having a cam surface 20. In FIG. 3, the shaft 36 can extend through the hole 34. As illustrated in FIG. 3, the shaft 36 includes an outside portion 36*a* and an inside portion 36*b*. The disc 44 is coupled to the end of the shaft 36 at the inside portion 36*b*. As illustrated in FIG. 3, the disc 44 is coupled to the end of shaft 36 such that the center of the disc (not shown) is off-center from the end of the shaft. For example, the disc 44 is eccentric with respect to the shaft 36.

In FIG. 3, the screen retainer 18 can also include a rotation device 38. The rotation device 38 can be adapted to rotate the shaft 36. In FIG. 3, the rotation device is a handle 38; however, in other embodiments, the rotation device 38 can be a crank, or other mechanism adapted to rotate the shaft 36. The rotation device 38 is coupled to the outside portion 36*a* of the shaft 36. In at least one embodiment, the rotation device 38 is coupled to the outside portion 36*a* of the shaft 36 by a retaining nut 39; however, in other embodiments, the rotation device 38 can be coupled to the shaft 36 by a welding coupling, a pin, an adhesive or other coupling mechanism.

Also illustrated in FIG. 3 is at least one stop 45, 47. In FIG. 3, there are two stops 45, 47. Stop 47 is coupled to the sleeve 32. Stop 45 is coupled to the rotation device 38. Stops 45 and 47 can be adapted to prevent over rotation of the shaft 36. Since the inside portion 36*b* of rod 36 is secured off center relative to disk 40, stops 45 and 47 are set such that a 10 degree over rotation once maximum tension force is applied to the tensioning device 22. This locks the tensioning device 22 under in a tensioning position. This particular example the over rotation is about 10 degrees, though any particular over rotation which maintains the tensioning device 22 in a locked tension position is suitable.

Also shown in FIG. 3, is the screen 14 mounted to the wall 30 of the basket 16. For example, the screen 14 is mounted to a screen support 13 mounted to the wall 30 of the basket 16. In exemplary embodiment in FIG. 3, there is a seal 15 between the screen 14 and the screen supports 13. In at least one exemplary embodiment of a screen retainer 10 having adjustable tensioning, in an installed configuration, the disc 44 of the shaft 36 can be inserted through an aperture 46 of the housing 21. As the shaft 36 is rotatable, the disc 44 at the end of the shaft 36 can be rotatable within the aperture 46. When the bushing 400 is received by the surface 24 of the tensioning device in the aperture 46, the disc 44 engages the bushing 400. As the disc 44 is eccentrically coupled to the shaft 36, the disc 44 can eccentrically engage the bushing 400.

While FIG. 3 illustrates an engagement member 40 that is a shaft 36 having a disc 44 coupled thereto, it will be appreciated that the engagement member 40 can be an eccentric cam, a cam shaft, a disc, or other engagement member adapted to engage the bushing 400 of the screen retainer 44. For example, the engagement member 40 can be adapted to rotate within the bushing 400. As will be explained below, the bushing 400 has a thickness 600 (illustrated in FIG. 6) that varies about a center 635 of the bushing 400. The interaction between the varying thickness 600 of the bushing 400 and the engagement member can vary the compressive force placed on the screen 14 by the tensioning device 22. In at least on exemplary embodiment, the engagement member 400 can be an eccentric cam coupled to a pin attached to the side wall 30 of the basket 16. The eccentric cam can be rotatable on the pin, and thereby rotate within the bushing 400 in an assembled or installed configuration. The eccentric relationship between the engagement member 40 and the bushing 400 can enhance the compressive force placed on the screen 14 by the tensioning device 22. It will be appreciated that the shape and thickness of the bushing 400, as will be explained below, will vary the compressive force placed on the screen 14 by the tensioning device 22.

FIG. 4 illustrates an exploded view of an exemplary tensioning device 22 and an exemplary bushing 400 of the screen retainer 18 having adjustable tensioning. As illustrated in FIG. 4, the tensioning device 22 includes a surface 24 adapted to receive the bushing 400. In FIG. 4, the surface 24 defines an aperture 46 with the tensioning device 22. The tensioning device 22 includes a lower surface 48. Although not shown in FIG. 4, a spring 26 is embedded within the tensioning device 22. In at least one embodiment, the spring 26 can be embedded such that it lays in a plane which is substantially parallel to a side wall 30 of a basket 16 of a shale shaker 10 when the tensioning device 22 is in an installed position in the shale shaker 10. Also illustrated in FIG. 4, the tensioning device 22 includes at least one screen contact surface 28. FIG. 4 illustrates two screen contact surface 28; however those of ordinary skill in the art will appreciate that there can be fewer or more contact surfaces 28 than as illustrated. The spring 26 can be located between the aperture 46 and the at least one screen contact surface 28. In the particular embodiment illustrated in FIG. 4, the two screen contact surfaces 28 are spaced apart from each other to allow deflection of the lower surface 48 and of the spring 26 when the tensioning device 22 is in a position for retaining the screen 14.

Also illustrated in FIG. 4 is an exemplary bushing 400. The bushing is a structure having a thickness 600 (shown in FIG. 6) and a center 635 (shown in FIG. 6). The thickness 600 of the bushing varies about the center 635. In the particular non-limiting embodiment of FIG. 4, the bushing 400 includes a front 405, a back 410, and wall 415 extending therebetween. In FIG. 4, the wall 415 has the varying thickness 600 of the bushing. In at least one embodiment, the bushing 400 can optionally a dial 420 on the front 405. In other embodiments, the dial 420 can be a handle, a knob, a grip or other protrusion. The bushing 400 can also optionally include a plurality of markings 500 (shown in FIG. 5). The each of the plurality of markings 500 can correspond to a thickness of the varying thickness 500 of the bushing 400. Also illustrated in FIG. 4, the bushing 400 includes a lip 425 formed at the back 410. The lip 425 can be adapted to secure the bushing 400 to the tensioning device 22, when the bushing 400 is received by the surface 24 of the tensioning device 22. While FIG. 4 illustrates that the surface 24 defines an aperture 46, those of ordinary skill in the art will appreciate that the surface 24 can simply be a notch, a semi-circular surface 24 formed on an edge of the tensioning device, or other surface adapted to receive the bushing 400. In at least one embodiment, the bushing 400 is can be removably received by the surface 24. For example, the bushing 400 can be adapted for snap-engagement with the surface. In other embodiments, the bushing 400 can be screwed into the surface 24, bolted to the surface 24, or otherwise received by and secured to the surface 24. Also illustrated in FIG. 4, the tensioning device 22 is an indication marker 805. The indication marker 805 is adapted to align with the markings 500 on the bushing 400 to indicate which thickness 600 the bushing 400 has been set to, and thereby indicating the amount of tensioning or compressive force to be placed on a screen 14 retained by the screen retainer 18.

Figure 5:
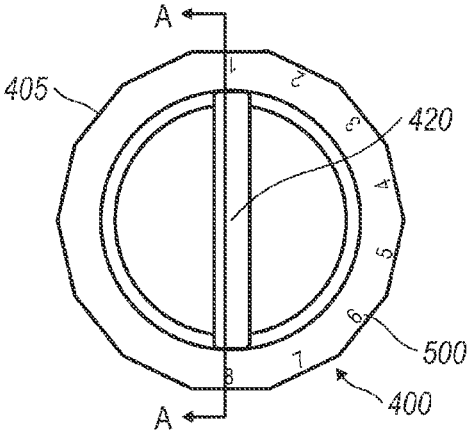
FIG. 5 is a front view of a bushing of a screen retainer having adjustable tensioning in accordance with an exemplary embodiment of the present disclosure.

FIG. 5 is a front view of a front face 405 of an exemplary bushing 400. As shown in FIG. 5, the front face 405 of the bushing 400 has a hexagonal shape; however, in other embodiments, the front face 405 can have other shapes. Also shown in FIG. 5, the front face 405 of the bushing 400 includes a plurality of markings 500. Each marking 500 can correspond to the thickness 600 of the portion of the bushing 400 bearing the marking 500. A the marking 500 corresponds to the thickness of that portion of the bushing 400, the marking thereby indicates an amount of compressive force that will be placed on the screen 14 when the bushing 400 is installed in the tensioning device 22 and the screen 14 is retained by the screen retainer 18. In FIG. 5, the markings 500 are etched onto the front face 405. In other embodiments, the markings 500 can be adhered to the bushing 400, painted on the bushing, or otherwise marked on the bushing 400. In FIG. 5, the markings 500 are numbers. The numbers are arranged in sequential order, with each number corresponding to the thickness of the portion of the bushing 500 bearing the marking 500. In other embodiments, the markings 500 can be words, can be the approximate amount of compressive force to be applied on the screen 14, or other marking indicative of the amount of compressive force to be applied to the screen 14 when the bushing 400 is received by the tensioning device 22 such that the marking 500 aligns with the indication marker 805 on the tensioning device 22. Thus, the bushing 400 can be rotated to align a marking 500 with the indication marker 805, thereby ensuring that the portion of the bushing having the thickness 600 corresponding to the marking 500 will engage the engagement member 40, when received by the tensioning device 22, to deliver a predetermined or known compressive force on a screen 14 mounted in the basket 16 of the shale shaker 10. Therefore, the cooperation of the bushing 400 and the tensioning device 22 provides for adjustable tensioning of the screen 14 by the screen retainer 14.

Figure 6:
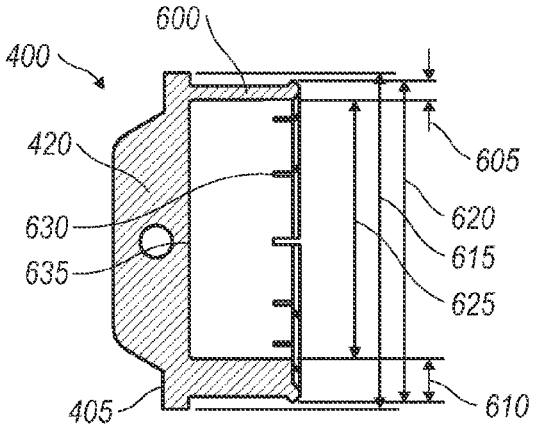
FIG. 6 is a cross-sectional view of the bushing illustrated in FIG. 5 taken along the A-A line.

FIG. 6 is a cross-sectional view of the bushing 400 illustrated in FIG. 5 taken along the A-A line. FIG. 6 illustrates the varying thickness 600 of the bushing 400. As illustrated in FIG. 6, the bushing 400 has a thickness 600 that varies about the center 635 of the bushing 400. For example, the bushing 400 has at least a first portion having a first thickness 605 and a second portion having a second thickness 610. In the particular non-limiting embodiment in FIG. 6, the first thickness 605 is smaller than the second thickness 610. Therefore, when the engagement member 40 of the tensioning device 22 engages the bushing 400 at the portion having the second thickness 610, the engagement member 40 will exert a larger force on the bushing 400 than if the engagement member 40 engaged the bushing at the portion having the first thickness 605. As a result, the engagement member 40 and the bushing 400 will exert a larger force on the surface 24 than if the engagement member 40 engaged the bushing at the portion having the first thickness 605. In response, the spring 26 will deflect more and cause the screen contact surface 28 to exert a larger compressive force on a screen 14 retained in the screen retainer 14 than if the engagement member 40 engaged the bushing at the portion having the first thickness 605. As the compressive force placed on the screen 14 varies based at least in part on the thickness 600 of the portion of the bushing engaging the engagement member 44, the screen retainer 18 provides adjustable tensioning of the screen 14 therein. Further details as to the adjustable tensioning of the screen 14 will be described in relation to FIGS. 8A-8D.

Also illustrated in FIG. 6, in at least one exemplary embodiment, the bushing 600 can have multiple circumferences. For example, the front 405 has a first circumference 615. The back 410 has second circumference 620. The wall 415 has a third circumference 625. In FIG. 6, the first circumference 615 and the second conference 620 are larger than the third circumference. FIG. 6 also illustrates that the wall 415 includes at least one slot 630. The slots 630 can be provided to allow the wall 415 to displace toward the center 635. As the wall 15 can displace toward the center 630, the bushing 400 can be enabled for snap-engagement with the surface 24 of the tensioning device 22. Additionally, the lip 425 of the bushing 400 can further secure the bushing 400 to the tensioning device 22.

Figure 7:
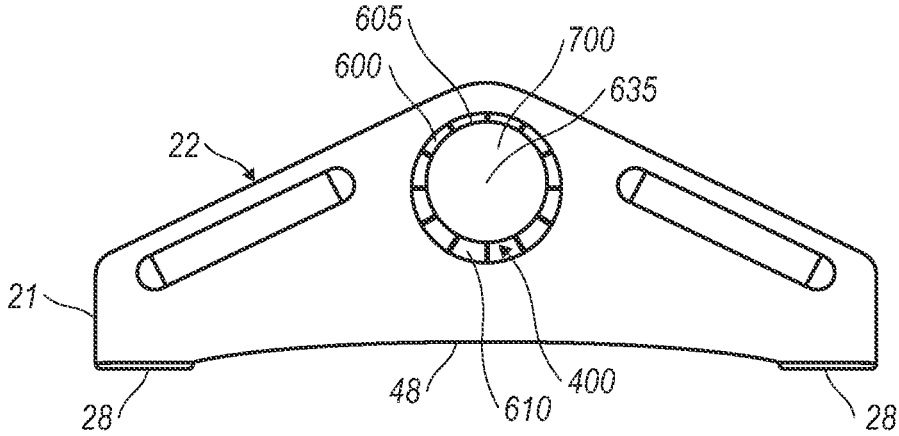
FIG. 7 is an rear view of a screen retainer having adjustable tensioning in accordance with an exemplary embodiment of the present disclosure illustrated in an assembled configuration.

FIG. 7 illustrates a rear view of an exemplary bushing 400 received by the surface 24 of the tensioning device 22. In FIG. 7, the varying thickness 600 of the bushing 400 is more clearly illustrated. As shown in FIG. 7, the thickness 600 of the bushing 400 radially increases about the center 635 such that the compressive force that will be placed on a screen 14 retained in the screen retainer 18 will correspondingly increase as the engagement member 40 engages a portion of the bushing 400 having a larger thickness than a previous portion of the bushing 400. In another embodiment, the thickness 600 of the bushing 400 incrementally increases about the center 635 of the bushing 400. In FIG. 7, the thickness 600 of the bushiness varies in a smooth transition such that the resulting interior surface of the bushing 400 forms a contiguous and smooth surface. In other embodiments, the thickness 600 need not vary in a smooth transition; for example, the thickness 600 of the bushing 40 can vary in a step-wise manner. FIG. 7 also illustrates that a cavity 700 can be defined by the interior surface of the portions of the bushing 400 have varying thicknesses 600. The cavity 700 is adapted to receive the engagement member 40. When the engagement member 40 is received by the cavity 700, the engagement member 40 can engage an interior surface of at least one portion of the bushing 400 having a thickness 600. As the engagement member 400 engages the bushing 400, the engagement member 40 can exert a force on the bushing 400, thereby exerting a force on the surface 24 which receives the bushing 400, thereby causing the spring 26 of the tension to deflect and causing the screen contact surfaces 28 to engage a screen 14 and place a compressive force on the screen 14, thereby placing the screen 14 in tension when retained by the screen retainer 18.

FIGS. 8A-8D illustrate the cooperation between a bushing 400 and a tensioning device 22 to secure a screen 14 in a shale shaker 10. As illustrated in FIGS. 8A-8D, the screen 14 is secured to the tensioning device 22 beneath the screen contact surface 28, which are beneath the bushing 400. FIGS. 8A-8D illustrate a front 820 of the screen retainer 18 and a back 825 of the screen retainer 18 with the bushing 400 rotated in various positions. FIGS. 8A-8D are for exemplary purposes, and those of ordinary skill in the art will appreciate that the screen retainer having adjustable tensioning can be implemented in other embodiments to achieve the technical advantages described herein.

Figure 8A:
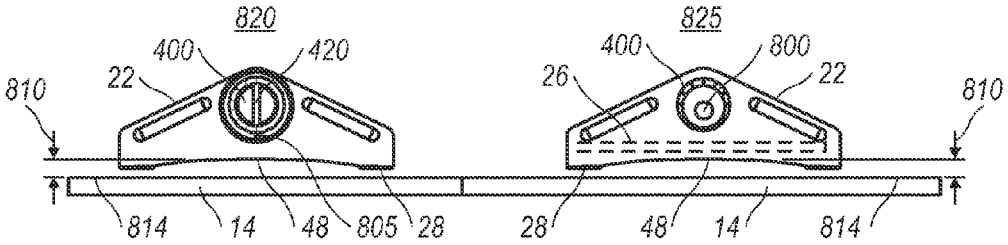
FIGS. 8A-8D are illustrations of a screen retainer having adjustable tensioning in accordance with an exemplary embodiment of the present disclosure illustrating the variable tensioning of the screen retainer.

FIG. 8A illustrates a first position of the screen retainer 18 having a screen 14 releasably mounted therein. In FIG. 8A, the bushing 400 has been rotated and received by the surface 24 of the tensioning device 22 such that the dial 405 is perpendicular to the screen 14, and the tensioning device 22 is in an unlocked position. In FIG. 8A, the indication marker 805, the markings 500 (not shown), and the orientation of the dial 405 can signify the amount of compressive force that will be placed on the screen 14 when the engagement member 800 engages the bushing 400. It will be appreciated that in FIG. 8A, the tensioning device 22 is in both the first position and an unlocked position. In the unlocked position, the engagement member 40 has been placed in a position that does not exert a force on the bushing 400. For example, in FIG. 8A, the engagement member 40 is an eccentric cam. In the exemplary non-limiting example of the unlocked position illustrated in FIG. 8A, the eccentric cam 800 has been rotated such that the eccentric cam 800 is not engaged with portion of the bushing 400 aligned with the indication maker 805. When the tensioning device 22 is placed in the locked position to thereby place tension and a compressive force on the screen 14, the eccentric cam 800 can be rotated such that the eccentric cam 800 will engage the portion of the bushing 400 aligned with the indication marker 805, for example.

In the locked position and the first position, a first portion of the bushing 400 having a first thickness is aligned with the indication marker 805 of the tensioning device 22. In the locked position, the eccentric cam 800 can engage a portion of the bushing 400 having a thin thickness. As the eccentric cam 800 engages a portion of the bushing 800 having a thin thickness, a smaller force is exerted on the bushing 400 than if the eccentric cam 800 engaged a portion of the bushing 400 having a larger thickness. As a result, the spring 26 and the bottom surface 48 of the tensioning device 22 deflect a distance 810 perpendicularly toward the screen 14.

Figure 8B:
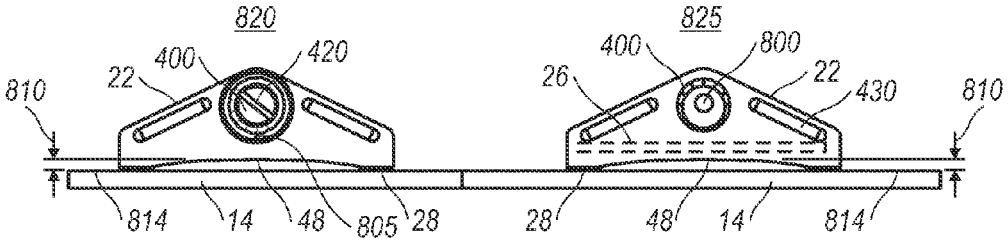

FIG. 8B illustrates a second position of the screen retainer 18 having a screen 14 releasably mounted therein. In FIG. 8B, the bushing 400 has been removed from the surface 24, rotated approximately forty-five degrees from the position of the bushing 400 illustrated in FIG. 8A, and re-inserted into the tensioning device 22, and the tensioning device 22 has been placed in the locked position to retain the screen 14 in the screen retainer 18. In this second position, the forty-five degree rotation position aligns a second portion of the bushing 400 having a second thickness with the indication marker 805 of the tensioning device 22. In this second position, the second thickness is larger than the first thickness illustrated in FIG. 8A. As shown in the back 825 of the tensioning device 22, the eccentric cam 800 can engage a portion having a larger thickness than that in FIG. 8A. As a result, a larger force is exerted by the eccentric cam 800 onto the bushing 400, and thereby onto surface 24 of the tensioning device 22. As a result the bottom surface 48 and the spring 26 deflect a greater distance 810 in this second position illustrated in FIG. 8B than in the first position illustrated in FIG. 8A. In other words, in FIG. 8B, the screen 14 has a greater compressive force exerted thereon by the screen contact surface 28 of the tensioning device 22 and therefore is held in under more tension than in FIG. 8A.

Figure 8C:
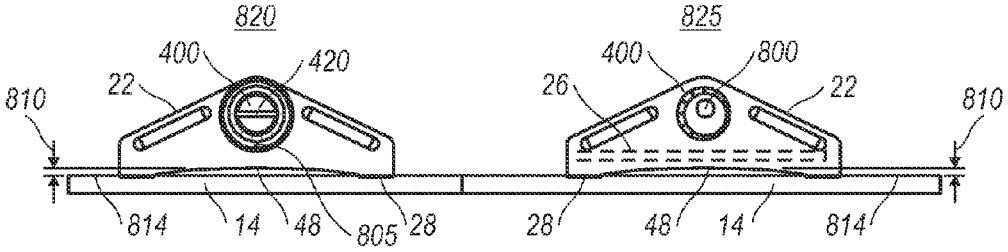

FIG. 8C illustrates a third position of the screen retainer 18 having a screen 14 releasably mounted therein. In FIG. 8C, the bushing 400 has been removed from the surface 24, rotated approximately ninety degrees from the position of the bushing 400 illustrated in FIG. 8A, and re-inserted into the tensioning device 22, and the tensioning device 22 has been placed in the locked position to retain the screen 14 in the screen retainer 18. In this third position, the ninety degree rotation position aligns a third portion of the bushing 400 having a third thickness with the indication marker 805 of the tensioning device 22. In this third position, the third thickness is larger than the first thickness illustrated in FIG. 8A and larger than the second thickness illustrated in FIG. 8B. As shown in the back 825 of the tensioning device 22, the eccentric cam 800 can engage a portion having a larger thickness than those in FIGS. 8A-8B. As a result, a larger force is exerted by the eccentric cam 800 onto the bushing 400, and thereby onto surface 24 of the tensioning device 22. As a result the bottom surface 48 and the spring 26 deflect a greater distance 810 in this third position illustrated in FIG. 8C than in the first position illustrated in FIG. 8A and greater than the distance 810 illustrated in the second position of FIG. 8B. In other words, in FIG. 8C, the screen 14 has a greater compressive force exerted thereon by the screen contact surface 28 of the tensioning device 22 and therefore is held in under more tension than in FIGS. 8A and 8B.

Figure 8D:
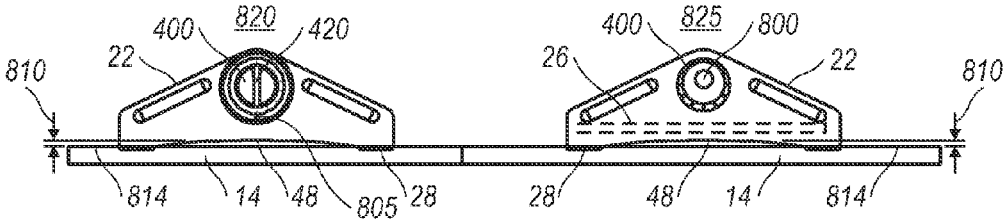

FIG. 8D illustrates a fourth position of the screen retainer 18 having a screen 14 releasably mounted therein. In FIG. 8D, the bushing 400 has been removed from the surface 24, rotated approximately one-hundred-eighty degrees from the position of the bushing 400 illustrated in FIG. 8A, and re-inserted into the tensioning device 22, and the tensioning device 22 has been placed in the locked position to retain the screen 14 in the screen retainer 18. In this fourth position, the one-hundred-eighty degree rotation position aligns a fourth portion of the bushing 400 having a fourth thickness with the indication marker 805 of the tensioning device 22. In this fourth position, the fourth thickness is larger than the first thickness illustrated in FIG. 8A, larger than the second thickness illustrated in FIG. 8B, and larger than the third thickness illustrated in FIG. 8C. As shown in the back 825 of the tensioning device 22, the eccentric cam 800 can engage a portion having a larger thickness than those in FIGS. 8A-8C. As a result, a larger force is exerted by the eccentric cam 800 onto the bushing 400, and thereby onto surface 24 of the tensioning device 22. As a result the bottom surface 48 and the spring 26 deflect a greater distance 810 in this fourth position illustrated in FIG. 8D than in the first position of FIG. 8A, greater than the distance 810 illustrated in the second position of FIG. 8B, and greater than the distance illustrated in the third position of FIG. 8C. In other words, in FIG. 8C, the screen 14 has a greater compressive force exerted thereon by the screen contact surface 28 of the tensioning device 22 and therefore is held in under more tension than in FIGS. 8A-8C.

The tensioning device 22 illustrated in FIGS. 8A-8D can comprise a polymer. For example, the polymer can be a thermoset or thermoplastic polymer, or an elastomer. The elastomer allows the spring 26 to bend under tension and return to normal when tension is released. The elastomer can be a thermoset castable polyurethane prepolymer, which was PTMEG polyether based and extended with 4,4'-methylene-bis-o-chloroanaline. The cured polyurethane had a 75 Shore D hardness. Extra lubricity was achieved with the addition of a dispersible silicone additive. The spring 26 can be made of any material having spring characteristics. In one embodiment, the spring 26 can be made of a rod of 17-4 stainless steel, which is a heat treated stainless steel. With such a stainless steel, the rod does not need be cleaned or milled after the heat treatment. However, it will be appreciated the tensioning device 22, spring, bushing 400, and engagement member 40 can be made of any material that achieves the technical advantages of the screen retainer having adjustable tensioning as described herein.

One of ordinary skill in the art will appreciate that the features in each of the figures described herein can be combined with one another and arranged to achieve the described benefits of the presently screen retainer having adjustable tensioning. Additionally, one of ordinary skill will appreciate that the elements and features from the illustrated embodiments herein can be optionally included to achieve the described benefits of the presently disclosed screen retainer having adjustable tensioning. Various modifications to and departures from the disclosed embodiments will occur to those having skill in the art. The subject matter that is intended to be within the scope of this disclosure is set forth in the following claims.

What is claimed is:

1. A screen retainer for releasably mounting a screen to a screen support mounted within a basket, the screen retainer comprising:

a bushing having a center and a thickness varying radially about the center and having an inner cavity; and a tensioning device having at least:

a surface adapted to receive the bushing;

a spring responsive to the surface;

an engagement member comprising a cam disc having a cam surface, said cam disc being received by the inner cavity of the bushing, the cam disc configured to be eccentric with respect to the center of the bushing in the event the engagement member and the bushing are engaged; and at least one screen contact surface adapted to engage and place a compressive force placed on the screen when the screen is supported by the screen support and the spring is placed in compression by an exertion of force by the engagement member on the bushing in the event the engagement member and the bushing are engaged; and wherein the compressive force placed on the screen is varied based at least in part on a rotation of the bushing on the surface.

2. The screen retainer of claim 1, wherein the bushing and the tensioning device are located within the basket in an installed position.

3. The screen retainer of claim 1, wherein the thickness of the bushing incrementally increases about the center.

4. The screen retainer of claim 3, wherein the bushing includes a front having a dial, the dial comprising a plurality of markings, each marking corresponding to a thickness of the bushing.

5. The screen retainer of claim 1, wherein the thickness of the bushing radially increases about the center such that the compressive force placed on the screen increases as the engagement member engages a portion of the bushing having a larger thickness than a previous portion of the bushing.

6. The screen retainer of claim 1, wherein the bushing is removably received by the surface.

7. The screen retainer of claim 1, wherein the bushing is adapted for snap-engagement with the surface of the tensioning device.

8. The screen retainer of claim 1, wherein the bushing further includes:

a front;

a back having an opening to define the inner cavity and receive the engagement member; and a wall between the front end and the back end, the wall defining an interior circumference, and the wall having a thickness that varies along the circumference of the bushing.

9. The screen retainer of claim 8, wherein:

the back forms a lip with respect to the wall, the lip adapted to secure the bushing to the surface of the tensioning device.

10. The screen retainer of claim 1, where in the engagement member further includes a shaft with said cam disc coupled to an end of the shaft.

11. The screen retainer of claim 1, wherein wherein the basket has a side wall and a sleeve coupled to the side wall with a hole extending substantially perpendicular to the side wall through the sleeve and side wall;

wherein the engagement member includes a cam shaft adapted to extend through the hole to the cam disc, the cam shaft having an outside portion and an inside portion; and wherein screen retainer further comprises a rotation device adapted to axially rotate the cam shaft, the outside portion coupled to said rotation device.

12. The screen retainer of claim 1, wherein the basket has a side wall;

the surface defines an aperture adapted to receive the bushing;

the spring is an elongated spring embedded in the tensioning device and laying in a plane which is substantially parallel to the side wall when the tensioning device is in an installed position;

the at least one screen contact surface are two screen contact surfaces extending below a lower surface of the tensioning device; and the elongated spring is located between the aperture and the two screen contact surfaces and wherein the two screen contact surfaces are spaced from each other to allow deflection of the lower surface and the elongated spring when the tensioning device is in a position for retaining the screen.

13. The screen retainer of claim 1, wherein the tensioning device has an upper portion, the upper portion defining the surface;

the spring is an elongated spring having first end portion, a second end portion, and a mid portion;

the at least one screen contact surface is two screen contact surfaces, the elongated spring is located between the upper portion and the two screen contact surfaces;

one screen contact surface is located on the first end portion and the other screen contact surface is located on the second end portion; and the upper portion is coupled to the mid portion.

14. A shale shaker comprising:

a base;

at least one shaker screen;

a basket mounted movably with respect to and on the base;

a screen support mounted within the basket; and a screen retainer for releasably mounting a shaker screen to the screen support within the basket, the screen retainer having:

a bushing having a center and a thickness varying radially about the center and having an inner cavity; and a tensioning device having at least:

a surface adapted to receive the bushing;

a spring responsive to the surface;

an engagement member adapted to engage the bushing, the engagement member comprising a cam disc having a cam surface, said cam disc being received by the inner cavity of the bushing and being eccentric with respect to the center of the bushing in the event the engagement member and the bushing are engaged; and at least one screen contact surface adapted to engage and place a compressive force placed on the screen when the screen is supported by the screen support and the spring is placed in compression by an exertion of force by the engagement member on the bushing in the event the engagement member and the bushing are engaged;

wherein the compressive force placed on the screen is varied based at least in part on a rotation of the bushing on the surface;

wherein the engagement member and tensioning device are located within the basket.

15. The shale shaker of claim 14, wherein the thickness of the bushing incrementally increases about the center; and the bushing includes a front face having a dial, the dial comprising a plurality of markings, each marking corresponding to a thickness of the bushing.

16. The shale shaker of claim 14, wherein the bushing is removably received by the surface.

17. The shale shaker of claim 14, wherein the thickness of the bushing radially increases about the center such that the compressive force placed on the screen increases as the engagement member engages a portion of the bushing having a larger thickness than a previous portion of the bushing.

18. The shale shaker of claim 14, wherein the basket has a side wall and a sleeve coupled to the side wall with a hole extending substantially perpendicular to the side wall through the sleeve and side wall;

wherein the engagement member includes a cam shaft adapted to extend through the hole to the cam disc, the cam shaft having an outside portion and an inside portion; and wherein screen retainer further comprises a rotation device adapted to axially rotate the cam shaft, the outside portion coupled to said rotation device.

19. The shale shaker of claim 13, wherein the basket has a side wall;

the surface defines an aperture adapted to receive the bushing;

the spring is an elongated spring embedded in the tensioning device and laying in a plane which is substantially parallel to the side wall when the tensioning device is in an installed position;

the at least one screen contact surface are two screen contact surfaces extending below a lower surface of the tensioning device; and wherein the elongated spring is located between the aperture and the two screen contact surfaces and wherein the two screen contact surfaces are spaced from each other to allow deflection of the lower surface and the elongated spring when the tensioning device is in a position for retaining the framed screen.

20. The screen retainer of claim 1 wherein rotation of the bushing correspondingly moves said tensioning device toward and away from the screen.

* * * * *